US006701806B2

(12) United States Patent
Swanson et al.

(10) Patent No.: US 6,701,806 B2
(45) Date of Patent: Mar. 9, 2004

(54) MACHINE FOR CLAMPING MATERIAL TO BE FASTENED AND AUTOMATICALLY INSTALLING SCREWS

(76) Inventors: Jeffrey S. Swanson, 3650 Wilcox Rd., Suite B, Stockton, CA (US) 95215; Eric S. Swanson, 3650 Wilcox Rd., Suite B, Stockton, CA (US) 95215

( * ) Notice: Subject to any disclaimer, the term of this patent is extended or adjusted under 35 U.S.C. 154(b) by 0 days.

(21) Appl. No.: 10/046,689

(22) Filed: Jan. 16, 2002

(65) Prior Publication Data

US 2003/0131690 A1 Jul. 17, 2003

(51) Int. Cl.[7] ..... B25B 17/00

(52) U.S. Cl. ..... 81/57.37; 81/13; 81/55; 81/434

(58) Field of Search ..... 81/13, 55, 57.37, 81/434

(56) References Cited

U.S. PATENT DOCUMENTS 3,757,407 A * 9/1973 Bomar ..... 221/279
5,101,697 A * 4/1992 Fishback ..... 81/434
5,988,026 A * 11/1999 Reckelhoff et al. ..... 81/434
6,085,616 A * 7/2000 Habermehl ..... 81/55
6,148,507 A * 11/2000 Swanson et al. ..... 29/816
6,247,387 B1 * 6/2001 Ketteringham ..... 81/467
6,425,306 B1 * 7/2002 Habermehl ..... 81/434

* cited by examiner

*Primary Examiner*—Lee D. Wilson
*Assistant Examiner*—Alvin J. Grant

(57) ABSTRACT

A machine for clamping material to be fastened and automatically installing screws has been disclosed through a method of a self loading barrel that also aligns the screw to be installed thus relieving the operator of the strain of holding an unstable screw in place during the driving phase. This machine also automatically provides the force needed to keep the fastener from stripping at the head driver connection point through its unique design and also relieving the operator of much of the work related strain associated with these operations. This tool also provides another benefit in its design by automatically clamping the material during the fastening operation, that would normally have to be done separately with another tool. Another embodiment permits single loading of fasteners into the barrel.

10 Claims, 7 Drawing Sheets

MACHINE FOR CLAMPING MATERIAL TO BE FASTENED AND AUTOMATICALLY INSTALLING SCREWS

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates generally to the field of fastening light gauge metals, and more particularly to a machine for clamping material to be fastened and automatically installing screws.

Screws are the fastener of choice in construction of sheet metal and steel stud construction. For many years workers have been using various types of screw guns that are somewhat efficient in their operation but are relatively slow and cumbersome to operate due to several problems. First, the material to be fastened usually needs to be fastened with a clamp to hold the material in position and tightly together to accomplish a strong connection. Second, the operator must apply sufficient force behind the fastener to drive it properly which can be difficult or impossible if the operator is in a awkward or dangerous position. A similar system for clamping material but using a two part fastener was disclosed in U.S. Pat. No. 6,148,507 to Swanson, et al.

Other screw guns that are available are capable of self loading their fasteners into position for the next driving operation. These screw guns are very capable for their intended use for fastening drywall materials, wood, and plywood sheeting to already constructed steel stud members, but do not provide what is needed for the framing construction phase using metal studs as described below. The material still must be separately clamped by another device, the operator must use their own strength to apply force behind the fastener during the driving phase, and these tool provide little or no assistance for holding the fastener in its position during installation.

The problem with the existing technology is that the material still must be separately clamped by another device, the operator must use their own strength to apply force behind the fastener during the driving phase, and these tool provide little or no assistance for holding the fastener in its position during installation. The tool of the present invention relieves the operator of much of the physical counteractive forces that need to be applied by the hand, wrist, and arm during the work of installation. This will also help protect the operator of more nerve damage associated with this type of work. This new design installs fasteners faster, more correctly and consistent, and with less demand on the part of the operator.

BRIEF SUMMARY OF THE INVENTION

The primary object of the invention is to provide a screw gun that automatically clamps the material to be fastened.

Another object of the invention is to provide a screw gun that automatically applies the pressure needed to drive the screw into place.

Another object of the invention is to provide a screw gun that holds the screw in its driving position until securely driven.

Another object of the invention is to eliminate the need of a separate tool for clamping the two materials that will be fastened.

Another object of the invention is to have a tool that provides the force needed behind the fastener, during the driving phase of the fastener, while also providing equal force opposite the fastener inside the tool completely isolated from the operator. This will require much less physical demand from the operator when using the tool, and thus provide greater protection for the operator against hand and wrist work related injuries through tight grips, vibration, and torque associated with typical screw guns.

Another object of the invention is to have a tool that combines clamping the material, automatic loading of a fastener, and driving the fastener in one compact light tool. This will eliminate two separate tools that are needed now, and at the same time improve the quality and the speed of installing fasteners over current technology.

In accordance with a preferred embodiment of the invention, there is disclosed a machine tool for loading screw fasteners automatically, clamping the material to be fastened, applying the force necessary to install the fastener.

Other objects and advantages will become apparent from the following descriptions, taken in connection with the accompanying drawings, wherein, by way of illustration and example, an embodiment of the present invention is disclosed.

BRIEF DESCRIPTION OF THE SEVERAL DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiments are provided herein. It is to be understood, however, that the present invention may be embodied in various forms. Various aspects of the invention may be inverted, or changed in reference to specific part shape and detail, part location, or part composition. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
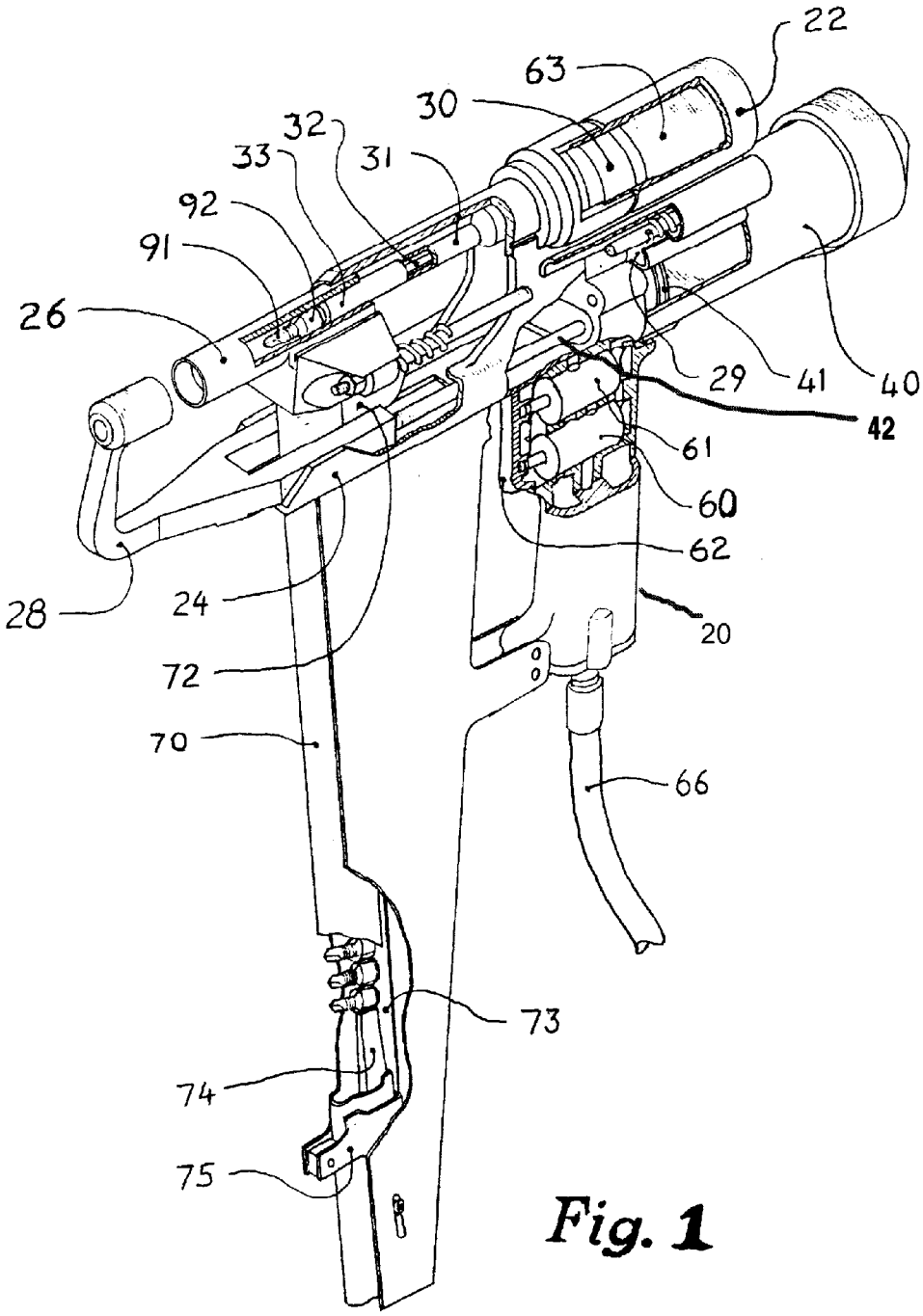
FIG. 1 is a perspective, partially exposed view of the screw gun of the present invention.

Turning first to FIG. 1, there is shown a perspective partially exposed view of the portable fastener tool of the present invention. Tool handle 20 provides the means for holding the tool which houses switch 62, upper air valve 61, and lower air valve 60 for operating the tool. Pneumatic hose 66 provides the air power needed for operating the tool by means of an air compressor not shown, but well known to those of skill in the art. Magazine fastener 70 holds a strip of pre assembled fasteners which are pushed into barrel clamp 26 by fastener pusher 75, the connection between the pre-assembled fasteners 90 and fastener pusher 75 is made by articulating pusher arm 74. Spring tape 73 and spring tape reel 72 provides the force needed to move fastener pusher 75 thus providing a means to load fastener guide 90 and screw 91 into barrel clamp 26. Tool handle 20 also provides a frame for various separate components to be combined into one tool. Air motor 63 is mounted inside frame 22 which is part of the tool frame, frame 22 holds gear box 30 and air motor 63 in place. Air motor 63 provides rotating power to gear box 30, which is then transferred to screw shaft 31, that is connected to screw driver tip 33, which can be removed for different type of driver tips so that different screws may be used. Exhaust air from motor 63 is vented through two exhaust ports 29. The connection between screw shaft 31 and screw driver tip 33, is made through shaft yoke 32. The force needed for clamping the material, loading, and driving the screw is developed by piston 41 that is located inside air cylinder 40. The power from piston 41 is transferred to two connecting rods 42, to material clamp 28.

Figure 2:
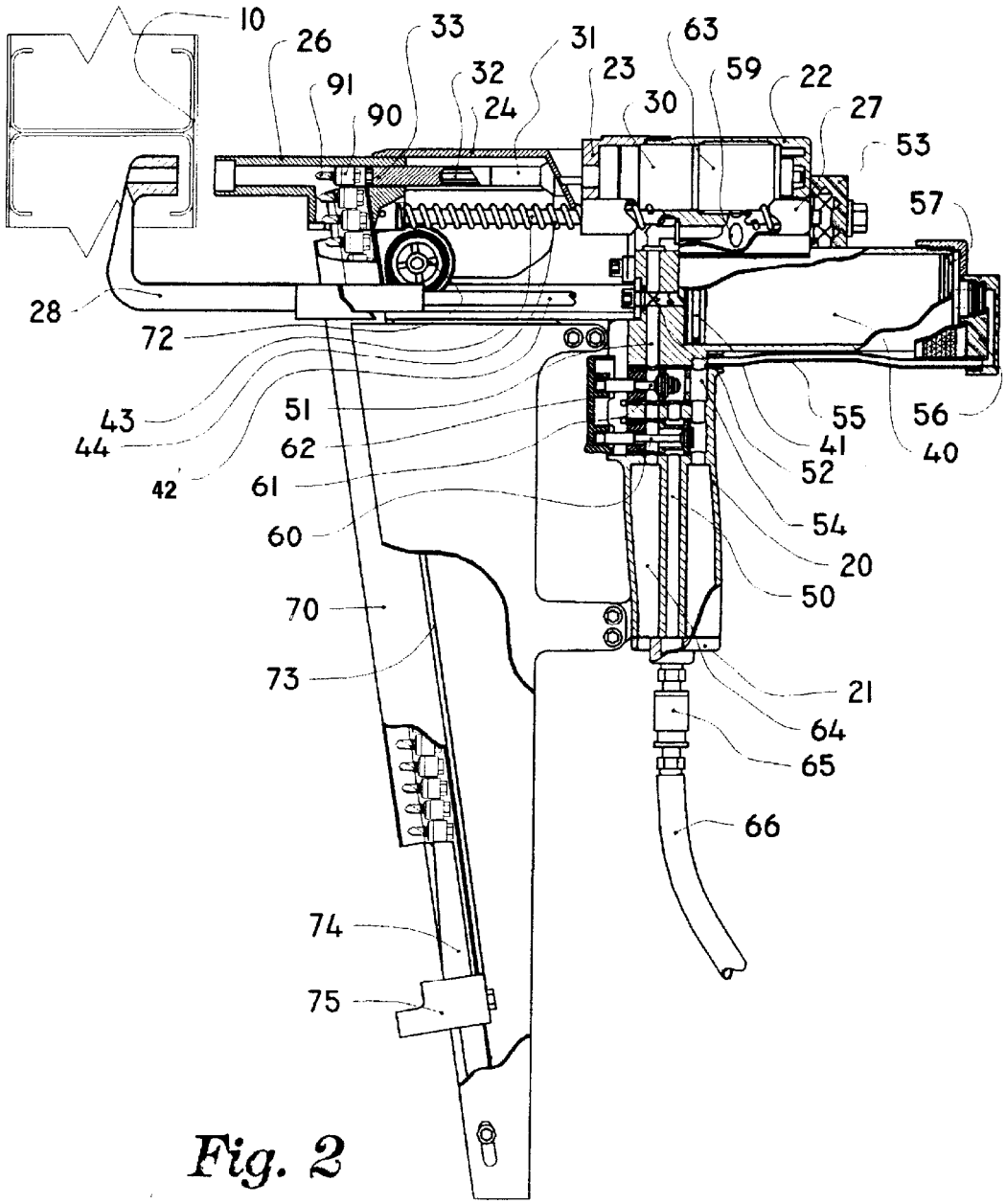
FIG. 2 is a cross sectional view of the screw gun with a loaded fastener.

The view shown in FIG. 2 reveals material 10 to be fastened at the start position of the tool and a better view of the various components of the tool and air passages. Barrel clamp 26 is in the fully extended position with a loaded screw 91 and fastener guide 90. Next material 10 to be fastened is placed in the breach between material clamp 28 and barrel clamp 26, at this time the operator will press start switch 62 which will reposition upper and lower air valves 61 and 60. Pressurized air from supply line 50 will now be allowed to start to enter motor-piston supply line 51. Air now will begin to move piston 41 to the opposite side of cylinder 40, the air on the opposite side of the piston will be vented first through cylinder cap 57, then line connector 56, next secondary air cylinder line 55 into the now opened lower air valve 60, and out lower exhaust port 64. Air that is not used for the above operation will continue to travel upward toward air directional block 53 into air motor 63 and vented out upper exhaust ports 59. Now the motor will provide the power needed to drill the screw through the connection between the motor and screw driver tip 33. During this operation pressure will continue to build against piston 41 which will be transferred through connecting rods 42 to material clamp 28. Pressure opposite this to clamp the material will be provided by barrel clamp 26 and the resistance of two compression springs 44, spring rods 43, and spring seat 27. The barrel clamp and material clamp will slide through the guides in guide fork 24. The screw will slide through the bore within barrel clamp 26.

Figure 3:
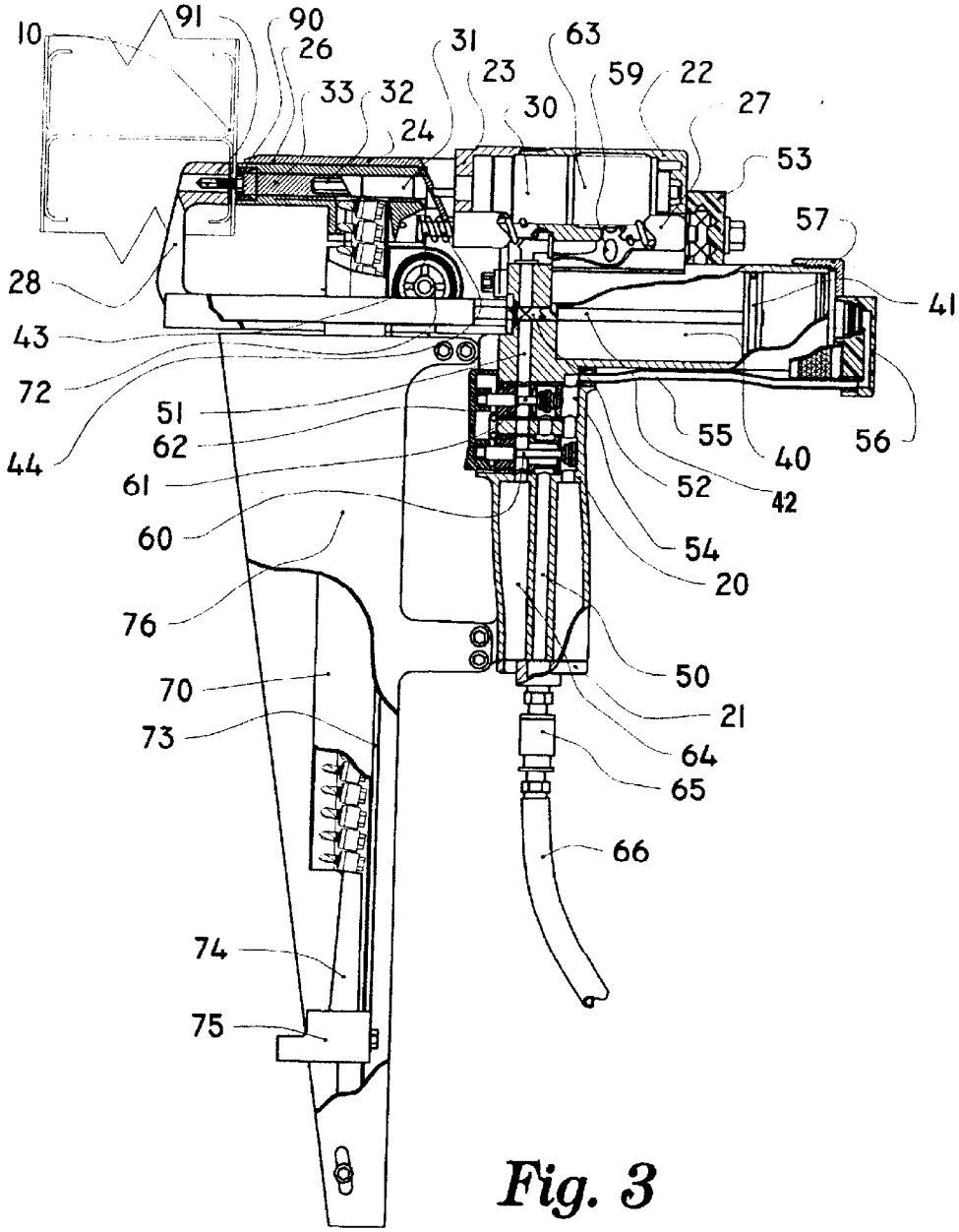
FIG. 3 is a cross sectional view of the screw gun with the fastener screwed into the material being fastened.

FIG. 3 shows material 10 is fastened by the screw 91. At this point the operator will release switch 62 and upper air valve 61 and lower air valve 60 will return to their original position, air pressure from piston 41 and motor-piston supply line will automatically vent trough motor and upper exhaust ports 59 after the air supply is cut off. Air from supply line 50 will now be able to enter the now closed piston exhaust circuit through air manifold 54, into secondary air cylinder line 55, trough line connector 56, and cylinder cap 57, into cylinder 40, now pushing piston 41 in the opposite direction. This will now cause connecting rods 42 to push the material clamp to its open position allowing barrel clamp 26 to be pushed back to its self loading position by compression springs 44. Once the barrel clamp is returned to its load position the next fastener can be loaded from magazine 70 and the pressure provided by spring tape 73 transferred through pusher arm 74.

Figure 4:
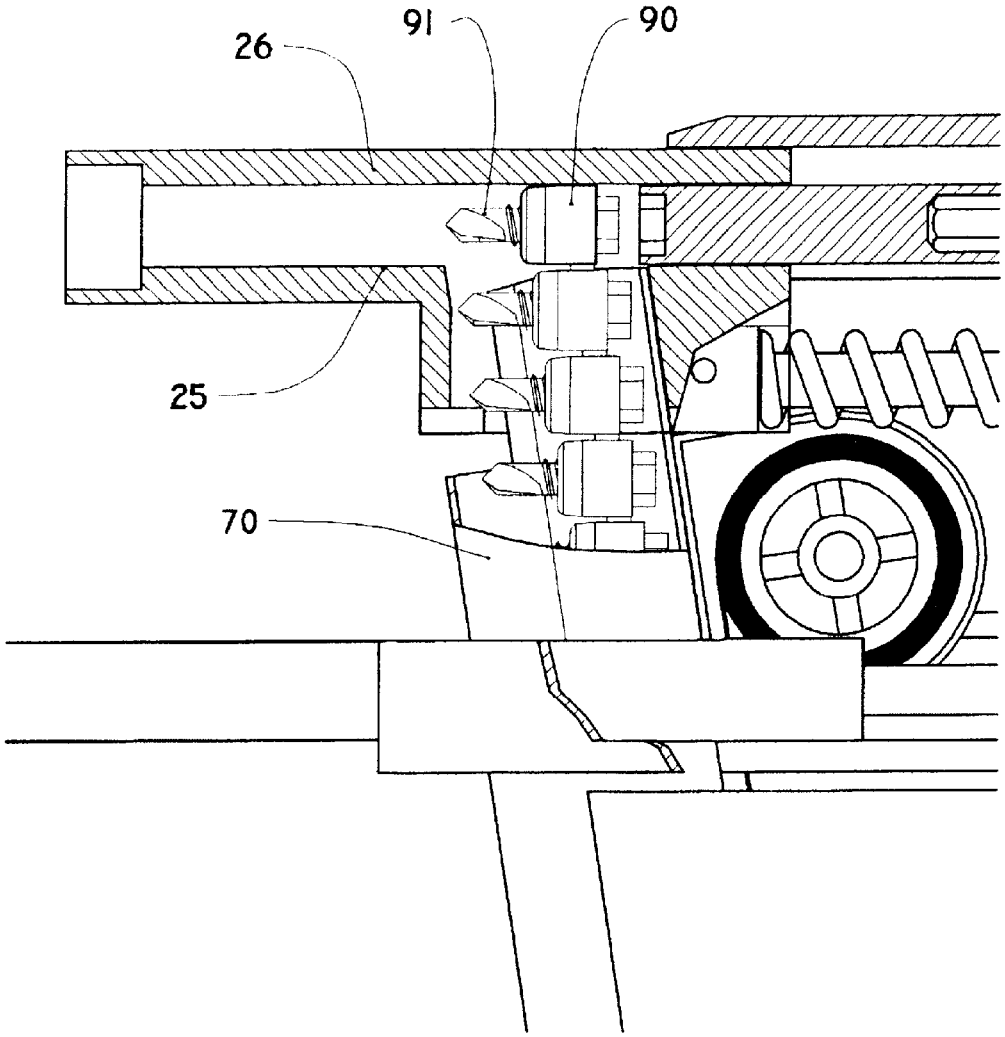
FIG. 4 is a cross sectional enlarged view of the invention's self loading barrel.

The next view shown in FIG. 4 shows an enlarged view of barrel clamp 26 and how fastener guide 90 and fastener 91 enter and fit into the bore 25 of the barrel clamp and the position of magazine 70, and the screw driver tip.

Figure 5:
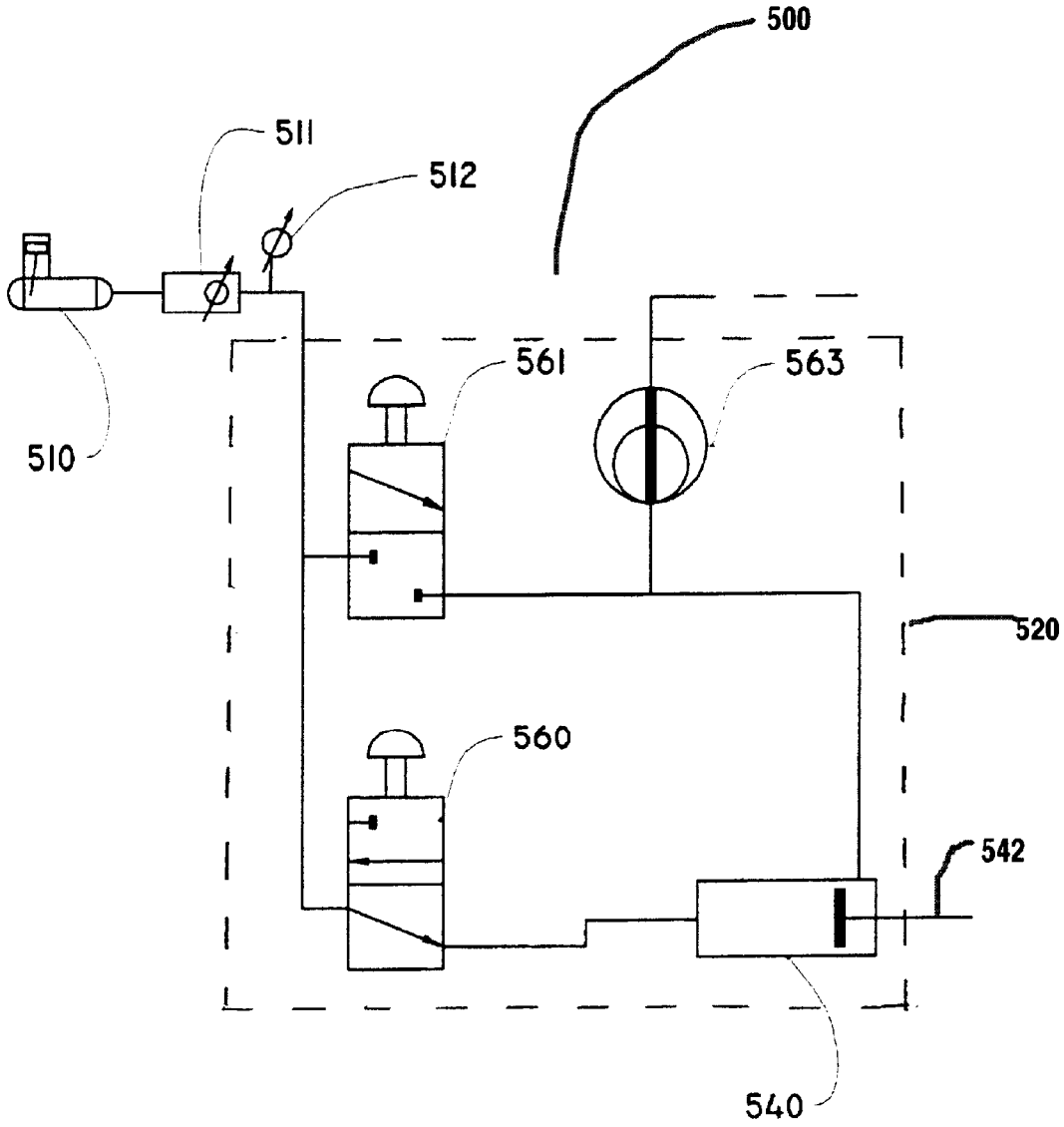
FIG. 5 is a pneumatic schematic of a circuit embodied in the invention.

FIG. 5 presents a schematic representation of pneumatic system 500 of the preferred tool screw fastener system. In general, the preferred system 500 includes air compressor power supply 510 which is connected to fastener tool 520. Control of the pneumatic system is through start switch 62 (not shown in this drawing) acting on air pressure regulator 512 which in turn causes the selective depression of lower valve 560 and upper valve 561 on the tool. In the neutral position, as shown in the schematic, air is allowed to enter only one side of air cylinder 540 from valve 560 pushing piston 542 to its start position in air cylinder 540. When the air valves are pushed to their run positions, air is rerouted to the motor, and also to the opposite side of the piston in air cylinder 540 from valve 561. Also the lower air valve opens vent 563 for air cylinder 540 to vent its start position pressure.

Figure 6:
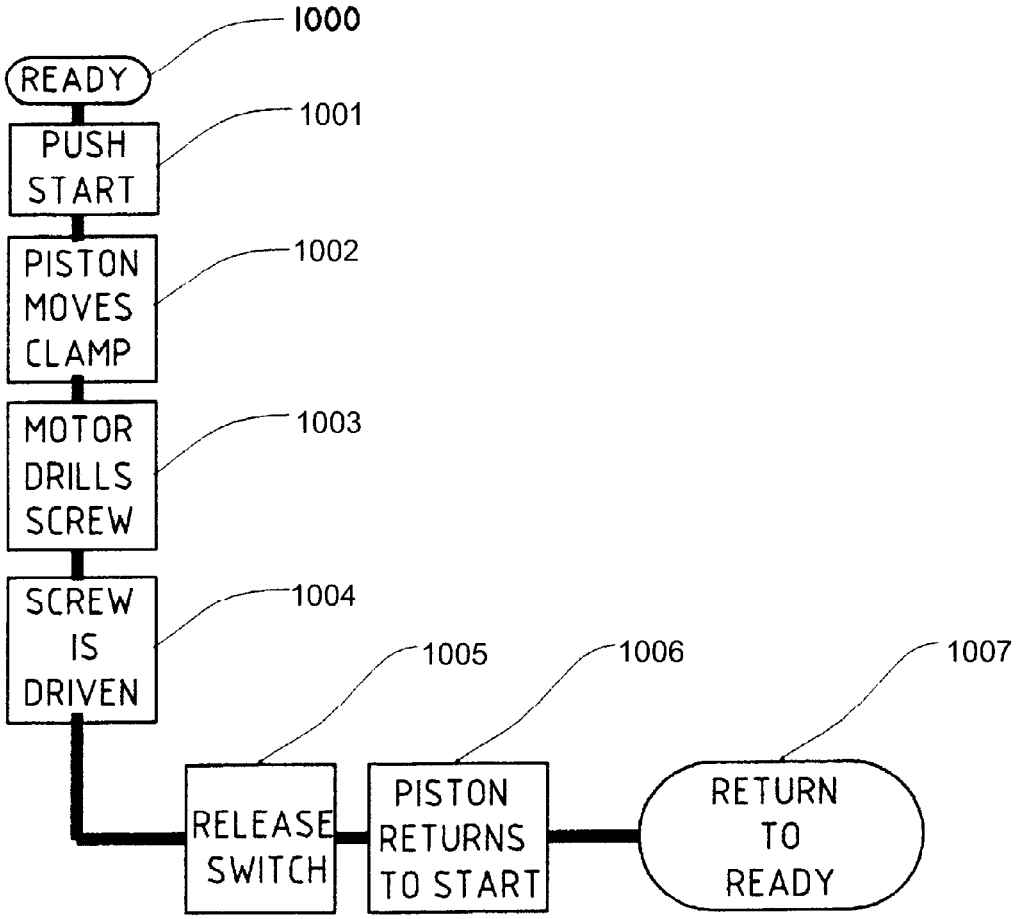
FIG. 6 is a flow chart of the operations that comprise the method of the invention.

FIG. 6 presents a flow chart of the tools fastening operation beginning when the material is ready to be clamped at step 1000. In general, this preferred system is operated by pushing tools start switch at step 1001, which provides pressure on the piston that causes the clamping of material to be fastened at step 1002 and also starts the motor that turns the screw driver tip that drills screw at step 1003, next the screw is driven into the material fastening the material at step 1004. Now the operator will release the switch to stop the operation at step 1005, the piston will return to start position at step 1006, and the tool is ready for the next operation at step 1007.

Figure 7:
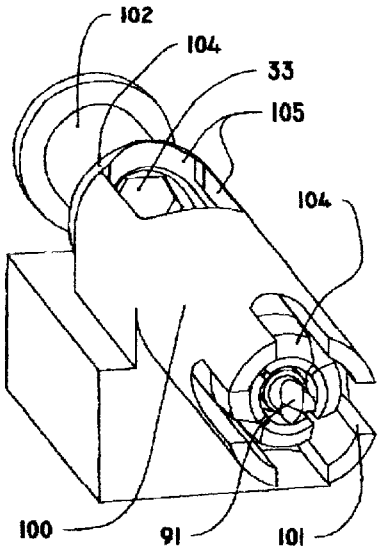
FIG. 7 is a perspective view of the alternate barrel assembly.

The view shown in FIG. 7 shows a perspective view of the alternate barrel loading assembly to be used in place of the self loading barrel clamp previously described. Barrel clamp 100 holds the various components for loading, positioning the screw, and clamping the material. Fastener guide 102 provides the chamber for holding the screw until driven, the screw is loaded into the fastener guide through chamber opening 105, guide spring 103 (shown in FIG. 8), is not shown for clarity. Screw 91 is positioned perpendicular to the material by means of alignment forks 104 which also has chamber opening 105. Alignment forks 104 are permitted to open by fork grooves 101 in barrel clamp 100. Also driver head 33 is shown in this view.

Figure 8:
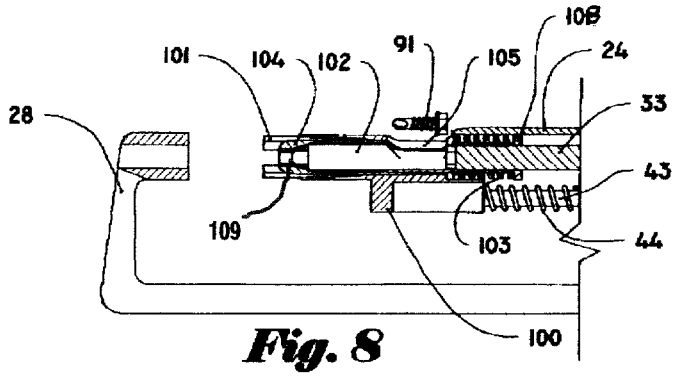
FIG. 8 is a cross sectional view of the manual loading barrel.

The view shown in FIG. 8 reveals the start position of the tool with the various components of the alternate barrel clamp. Material clamp 28 is in the full open position, opposite of barrel clamp 100, at this time the operator will load a single screw 91 through chamber opening 105 into fastener guide 102 which is a hollow tube at the center of the various components with a spring seat 108 at the right end. The pressure for providing the fastener guide to return to its normal start position is the guide spring 103. The alignment forks 104 are shown in their closed position within opening 109, which has slits cut in the length direction of the opening that allows for the forks to open for passage of the screw.

Figure 9:
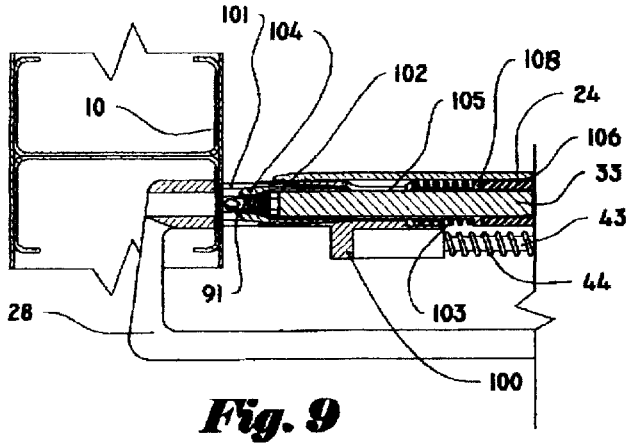
FIG. 9 is a cross sectional view showing the screw alignment feature.

The view shown in FIG. 9 shows fastener 91 pushed and engaged by drive 33, which rotates to drill the screw. The screw at this time is forced to align itself perpendicular to the material due to the design of alignment forks 104. At this point push ring 106 will start to engage the back of fastener guide 102, and spring seat 108, which will provide the force to push the fastener guide through the center and open alignment forks 104, with out the screw or the driver making contact with the forks, which will be described in connection with FIG. 10. Also material 10 is clamped in the same manner as described in FIGS. 2 and 3 by means of material clamp 28 and alternate barrel clamp 100.

Figure 10:
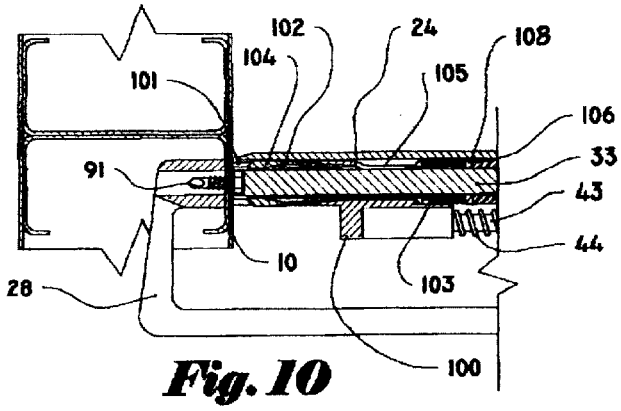
FIG. 10 is a cross sectional view showing the operation of the screw alignment feature.

The view shown in FIG. 10 shows material 10 fully fastened and clamped between material clamp 28, and barrel clamp 100. As screw 91 is driven fastener guide 102 is also driven forward by push ring 106. This causes the forward tapered end of fastener guide 102 to be pushed through the center of alignment forks 104 pushing them outwards into the openings provided by barrel fork grooves 101, opening the passage for the screw head to pass the alignment forks. This also compresses guide spring 103, which will later provide the energy to push fastener guide 102 to its start position allowing alignment forks 104 to close and the chamber opening to realign to the open position to allow the next screw to be loaded.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as is defined by the appended claims.

What is claimed is:

1. A machine for Clamping Material to be Fastened and Automatically Installing Screws comprising:

a self loading chamber capable of holding at least one fastener;

a barrel for positioning the fastener-to be driven;

a clamp opposite said barrel for holding material to be fastened against said barrel;

an automatically driven screw driver assembly for driving said fastener through said material wherein said chamber engages said fastener about its circumference while being driven.

2. A machine for Clamping Material to be Fastened and Automatically Installing Screws as claimed in claim 1 wherein said fastener is a screw.

3. A machine for Clamping Material to be Fastened and Automatically Installing Screws as claimed in claim 1 wherein said fastener is driven through air pressure.

4. A machine for Clamping Material to be Fastened and Automatically Installing Screws as claimed in claim 1 further comprising a magazine for holding a plurality of screws.

5. A machine for Clamping Material to be Fastened and Automatically Installing Screws as claimed in claim 1 wherein said clamp is moved by air pressure.

6. A machine for Clamping Material to be Fastened and Automatically Installing Screws comprising:

a chamber capable of holding at least one fastener;

a barrel for positioning the fastener to be driven;

a clamp opposite said barrel for holding material to be fastened against said barrel;

an automatically driven screw driver assembly for driving said screw through said material wherein said chamber holds said fastener about its circumference while being driven.

7. A machine for Clamping Material to be Fastened and Automatically Installing Screws as claimed in claim 6 wherein said fastener is a screw.

8. A machine for Clamping Material to be Fastened and Automatically Installing Screws as claimed in claim 6 further comprising a guide in said chamber.

9. A machine for Clamping Material to be Fastened and Automatically Installing Screws as claimed in claim 8 wherein said guide has a plurality of forks for holding said fastener.

10. A machine for Clamping Material to be Fastened and Automatically Installing Screws as claimed in claim 8 wherein said barrel has grooves for receiving said forks upon driving of said fastener.

* * * * *